US008475125B2

(12) United States Patent
Neeli et al.

(10) Patent No.: US 8,475,125 B2
(45) Date of Patent: Jul. 2, 2013

(54) SHROUD VORTEX REMOVER

(75) Inventors: Sudhakar Neeli, Karnataka (IN); Prakash Bavanjibhai Dalsania, Karnataka (IN)

(73) Assignee: General Electric Company, Schenectady, NY (US)

( * ) Notice: Subject to any disclaimer, the term of this patent is extended or adjusted under 35 U.S.C. 154(b) by 750 days.

(21) Appl. No.: 12/758,919

(22) Filed: Apr. 13, 2010

(65) Prior Publication Data

US 2011/0250064 A1 Oct. 13, 2011

(51) Int. Cl.
*F01D 25/30* (2006.01)

(52) U.S. Cl.
USPC ..... 415/211.2; 415/220; 415/221; 415/1

(58) Field of Classification Search
USPC ..... 415/211.2, 220, 221, 1
See application file for complete search history.

(56) References Cited

U.S. PATENT DOCUMENTS

| | | | | |
|---|---|---|---|---|
| 4,567,729 | A | 2/1986 | Roddis | |
| 5,209,634 | A * | 5/1993 | Owczarek | 415/150 |
| 5,257,906 | A * | 11/1993 | Gray et al. | 415/226 |
| 5,707,208 | A | 1/1998 | Kreitmeier | |
| 6,447,247 | B1 * | 9/2002 | Geiger | 415/211.1 |
| 6,533,546 | B2 | 3/2003 | Kreitmeier | |
| 7,780,403 | B2 * | 8/2010 | Fridsma | 415/148 |

* cited by examiner

*Primary Examiner* — Ninh H Nguyen
(74) *Attorney, Agent, or Firm* — Ernest G. Cusick; Frank A. Landgraff

(57) ABSTRACT

Tip shrouds on last stage buckets for condensing steam turbines may create significant blockage and form a vortex at the wall of the steam guide of the diffuser, causing the steam flow to separate from the wall of the steam guide. Vortex formation reduces the effective flow area for the remaining fluid to diffuse, causing poor recovery. An inward radial depression is provided of a predetermined depth and distance along an outer steam guide, which redirects the tip leakage flows slightly downward, reducing a shroud blockage effect. This deflection assists the main flow in rejoining the steam guide, thereby making the diffuser more effective.

20 Claims, 8 Drawing Sheets

Aggressive steam guide due to reduced axial length

SHROUD VORTEX REMOVER

BACKGROUND OF THE INVENTION

The invention relates generally to exhaust hoods for condensing steam turbines and more specifically to a diffuser shape within the exhaust hood.

In low-pressure steam turbines, pressure recovery for exhaust hoods can be divided into two parts: 1) pressure recovery from a diffuser inlet to end of a steam guide, and 2) pressure recovery from an end of the steam guide to a condenser. Getting pressure recovery downstream from the steam guide is very difficult as the exhaust hood contains many supporting struts after steam guide end. Consequently, any possible improvement within the steam guide should be employed.

Pressure recovery from the diffuser inlet to the end of steam guide depends on many parameters for the diffuser such as: 1) area ratio (outlet area/inlet area); 2) axial length available after last stage bucket centerline (derives turning radius); 3) last stage bucket tip leakage flows; and 4) last stage bucket shroud thickness (a larger shroud thickness creates more blockage).

The diffuser axial distance is measured as distance available from last stage bucket centerline to the end of diffuser, which is in general twice the bucket height and expressed as "2*Lbw/al". For example, if the bucket height is 40" then the diffuser axial length will be 80".

For a steam turbine, reducing the axial length of the diffuser would be cost beneficial, as it directly reduces length of the rotor shaft. A shorter axial length for the diffuser, such as "1.6*Lbw/al", requires a higher turning radius (more aggressive steam guide) to maintain required area ratio. A high turning radius will always leads to steam flow separation from the steam guide. FIG. 1 illustrates a first diffuser 10 receiving exhaust from a bucket 5 of length L with a tip shroud 6. The first diffuser 10 has a first axial length 15, a mild curvature 20 of the steam guide wall, and a first outlet area 30. A second shortened diffuser 50 is also illustrated. The second diffuser 50 includes a shorter axial length 55 with an increased outlet area 65 to maintain a same area ratio, thereby necessitating a more aggressive curvature 60 of the steam guide wall 70 that may lead to flow separation from steam guide wall.

One of the ways to reduce flow separation is using boundary layer blowoff, for example, by increasing the last stage bucket tip clearance. The jet coming from the tip clearance will reduce this flow separation, thereby leading to improved pressure recovery. But increasing the clearance is not advisable, as it will impact on last stage bucket performance.

Adding to this, a greater thickness for the shroud on last stage bucket may result in a flow blockage due to the vortex coming off the shroud. The presence of a vortex will increase losses further. FIG. 2 illustrates the effect of a tip shroud 6 on the last stage bucket 5 creating a vortex 75 within diffuser 10. The blockage by the tip shroud 5 creates a slow moving steam 70 forming the expanding slow-moving vortex 75.

Accordingly, it would be desirable to provide a means for improving pressure recovery with an aggressive steam guide.

BRIEF DESCRIPTION OF THE INVENTION

According to a first aspect of the present invention, a low-pressure steam turbine is provided including an inner casing with a last stage bucket annulus; tip shrouds on the buckets of the last stage bucket annulus; an exhaust hood surrounding the inner casing and an axial radial diffuser. The axial radial diffuser includes an inner steam guide and an outer steam guide within the exhaust hood at the outlet of the last stage bucket annulus. An inner wall of the outer steam guide is provided with an inward radial depression downstream from the outlet of the last stage bucket. The depth and location of the inward radial depression are established for reducing a vortex of steam on the wall of the outer steam guide.

According to another aspect of the present invention, an axial radial diffuser is disposed downstream from a last stage annulus of buckets for a condensing steam turbine within an exhaust hood. The diffuser includes an inner steam guide, an outer steam guide including an inner wall, and an inward radial depression disposed downstream from the outlet of the last stage bucket on the inner wall of the outer steam guide. The axial positioning and the depth of the depression are selected to reduce a steam vortex on the outer radial wall downstream from the outlet of the last stage bucket.

According to a further aspect of the present invention, a method is provided for reducing vortex formation on an outer steam guide of a diffuser for a steam turbine downstream of last stage buckets with tip shrouds. The method includes disposing an outer steam guide and an inner steam guide at an outlet annulus of last stage buckets, and providing an inward radial depression on a wall of the outer steam guide wherein the inward radial depression is disposed at a predetermined axial distance downstream from the centerline of the last stage buckets and at a predetermined depth selected for reducing a steam vortex on the outer radial wall downstream from the outlet of the last stage bucket.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including reducing the vortex of steam in a diffuser downstream from the tip shroud of the last stage buckets in a condensing steam turbine, thereby providing a larger diffusion area for more effective recovery and improved turbine performance. Higher pressure recovery may be achieved even with a reduced diffuser axial length in an aggressive steam guide. The invention provides for a highly effective flow diffusion, which yields a reduction of the backpressure for the turbine, thus allowing the turbine to have an increased overall pressure ratio for the same temperature reservoir of the thermodynamic cycle. This yields the opportunity to either deliver greater output for the same cycle conditions or to deliver the same output at a higher efficiency (i.e. for a reduced fuel input).

When the shroud thickness is very large, it creates significant blockage causing a vortex at the wall of the outer steam guide, thereby causing the steam flow to separate from the wall of the steam guide. The vortex, which is a slow moving fluid, occupies more and more area as it moves forward. Vortex formation reduces the effective flow area for the remaining fluid to diffuse, causing poor recovery.

It would be desirable to provide a mechanism to reduce or eliminate this vortex. The present invention provides an inward radial depression in the wall of an outer steam guide, reducing vortex strength by utilizing tip leakage flows. Thus higher pressure recovery is achieved without compromise on the area ratio for the diffuser.

Figure 1:
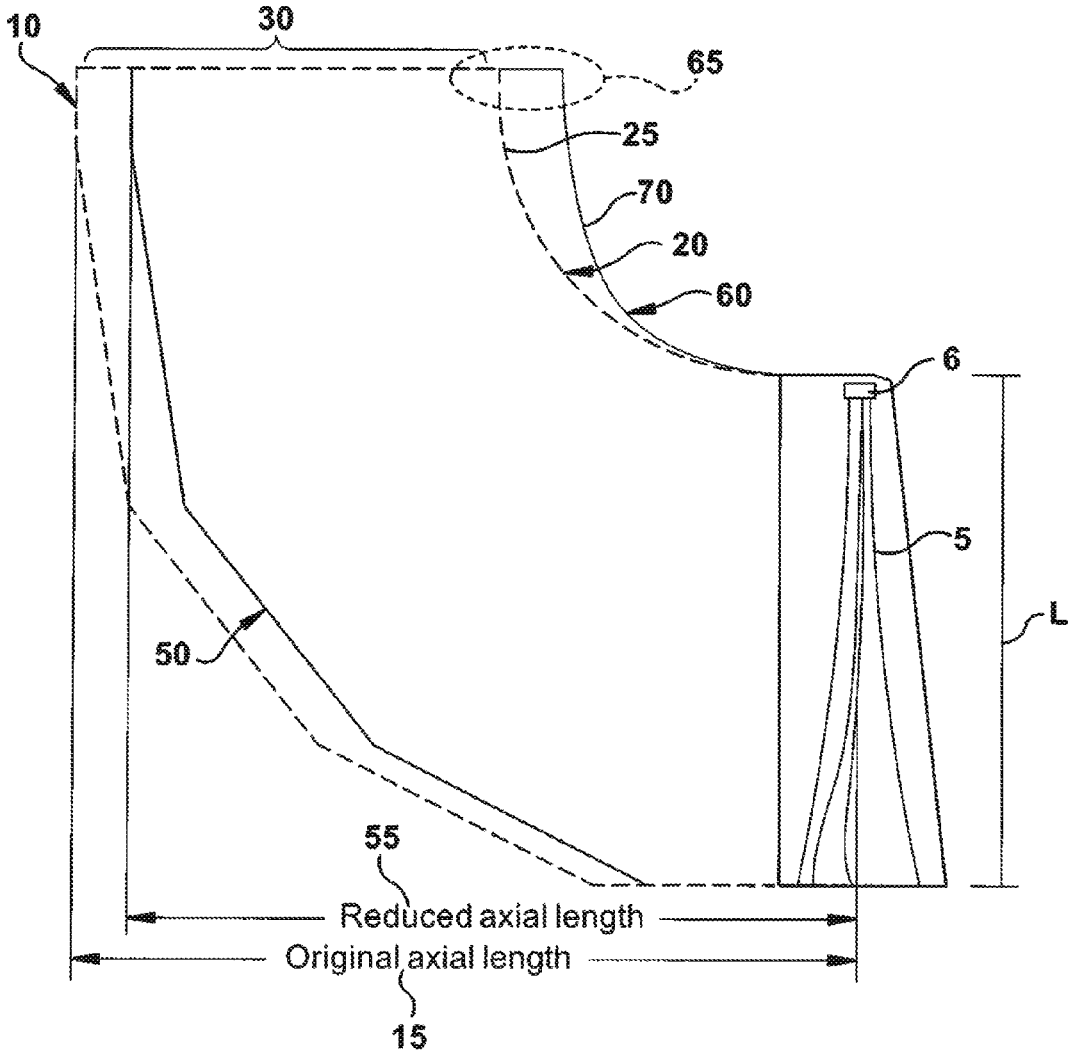
FIG. 1 illustrates a diffuser receiving exhaust from a turbine bucket of length L.
Figure 2:
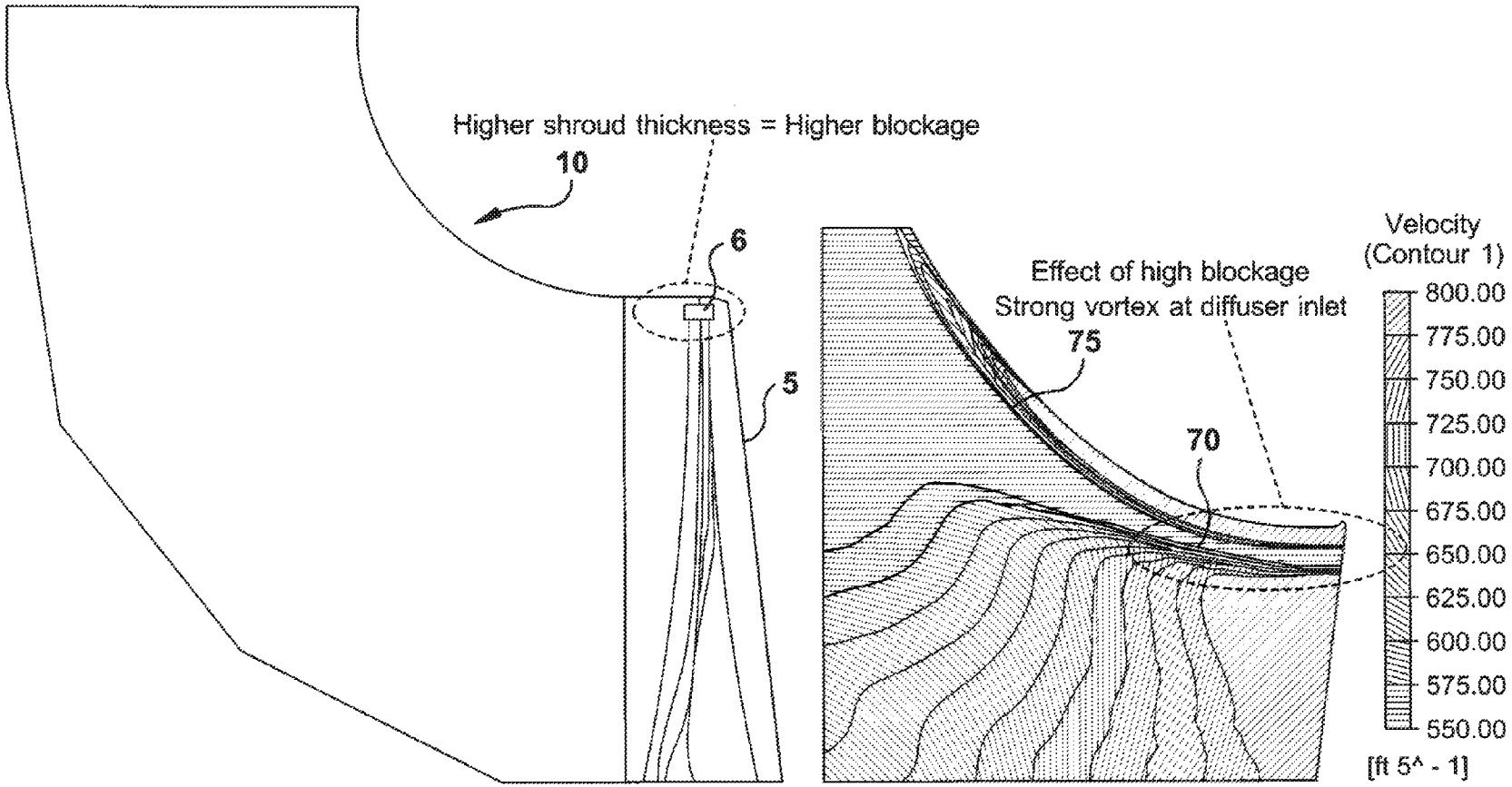
FIG. 2 represents the vortex created by a shroud on the last stage bucket.
Figure 4:
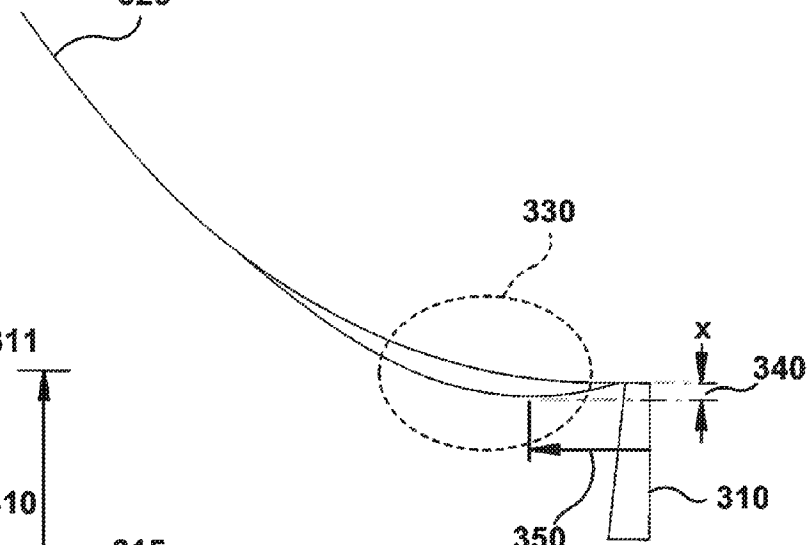
FIG. 4 illustrates an enlarged view of an inventive shape for an inner wall of a steam guide.
Figure 3:
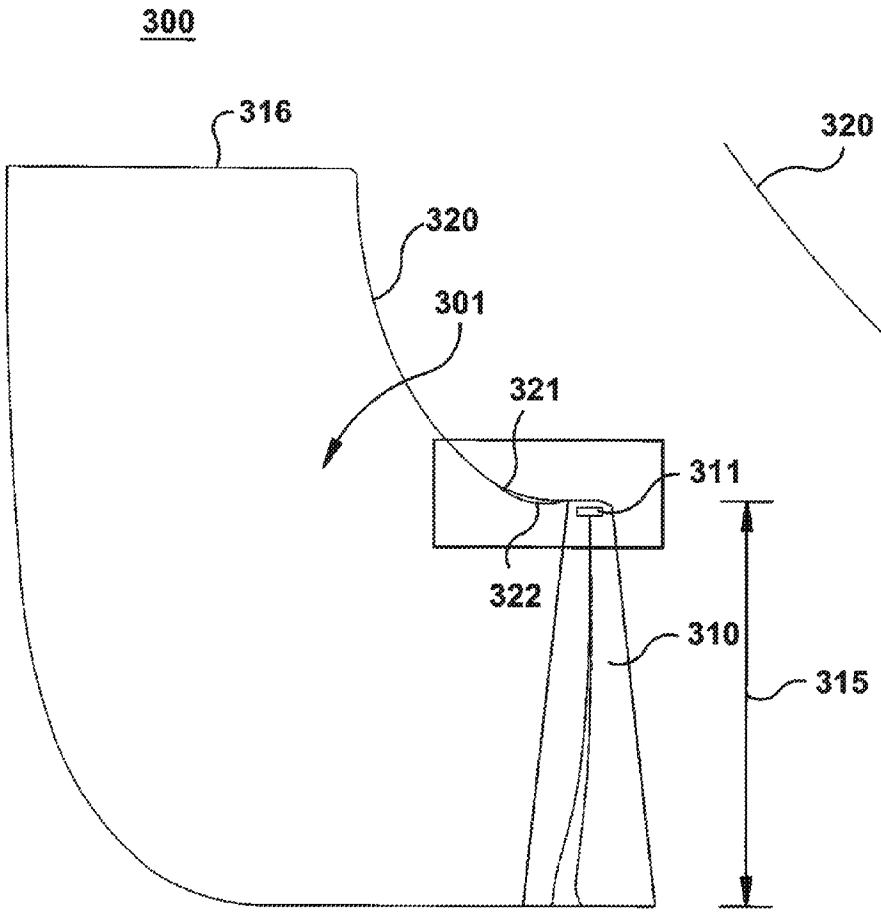
FIG. 3 illustrates a cross-sectional side view of an embodiment of an inventive diffuser downstream in exhaust path from a last stage with buckets with tip shroud.

FIG. 3 illustrates a cross-sectional side view of an embodiment of an inventive diffuser 300 downstream in exhaust path 301 from last stage buckets 310 with tip shroud 311. The diffuser has an inlet area 315 and an outlet area 316. An inner wall 320 of an outer steam guide is shown with a conventional upward concave curvature 321 and with an invention inward radial depression 322. FIG. 4 illustrates an expanded view 330 of the inner wall 320 of the outer steam guide downstream from the last stage bucket. The inward radial depression 340 of approximately 300 mils in depth has been disposed a distance 350 of about 3 inches from the axial center of last stage buckets 310. The dimensions are exemplary, but are not limited. The inward radial depression 340, which redirects the tip leakage flows slightly downward, reduces the shroud blockage effect. This deflection assists the main flow in rejoining the steam guide, thereby making the diffuser more effective.

For the conventional inner wall on the steam guide of a diffuser, the tip shroud of the bucket results in separation of the downstream steam flow. A main flow stream from the bucket flows below the tip shroud and a separate leakage flow path above the tip shroud passes along the wall of the steam guide. Further downstream, a large vortex of slow moving steam results. For the inventive diffuser with the inward radial depression on the inner wall of the steam guide, the flow along the inner wall and the main flow rejoin. The downstream vortex in the inventive diffuser is significantly smaller than the downstream vortex in the conventional diffuser. The smaller vortex in the diffuser results from the inward radial depression on the steam guide wall and leads to an improved diffuser performance.

Figure 5:
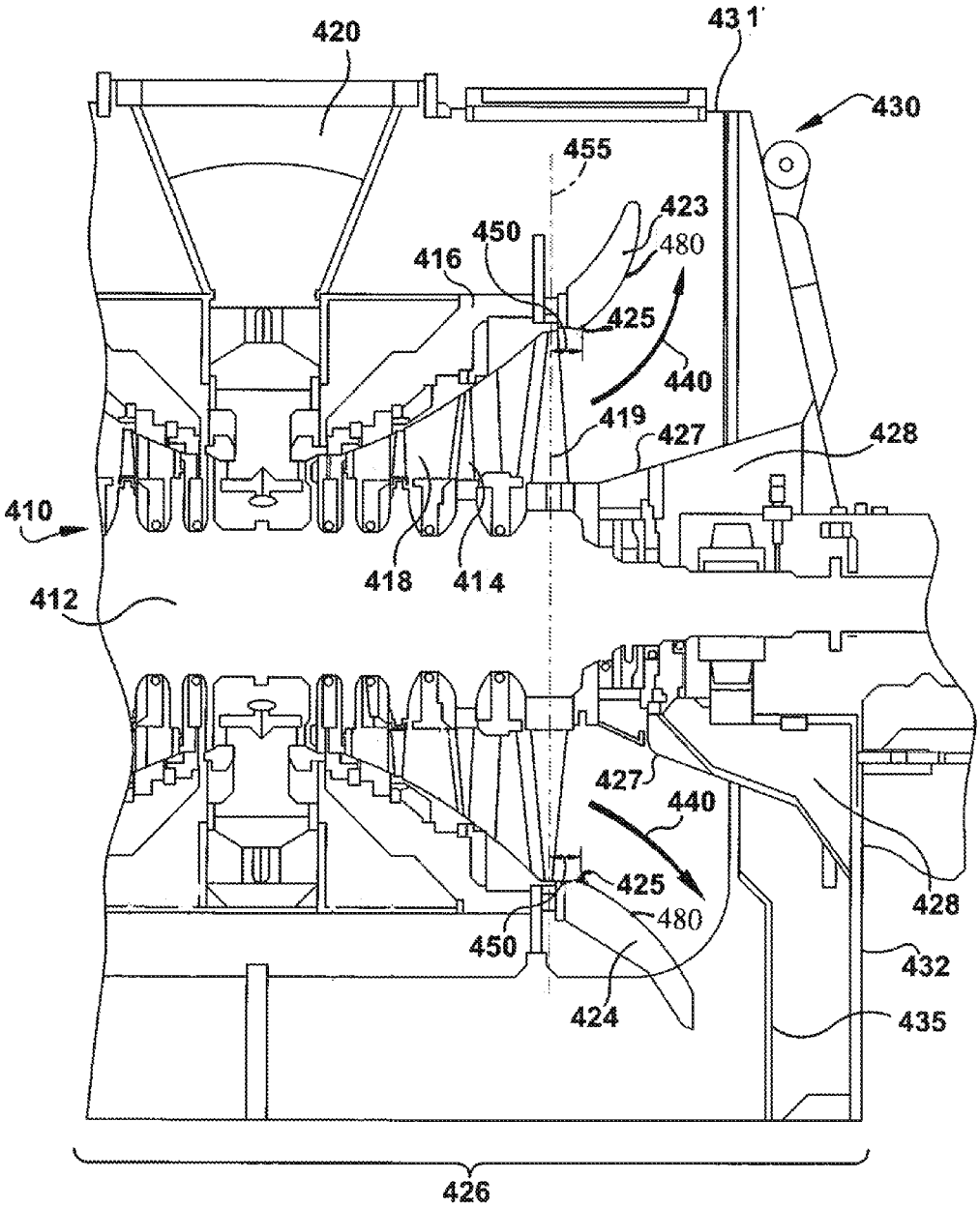
FIG. 5 illustrates a perspective partial cutaway view of a portion of a steam turbine, including an exhaust flow path with an inventive diffuser arrangement.

FIG. 5 illustrates a steam turbine with the inventive diffuser including an inward radial depression on the inner wall of the outer steam guide. The steam turbine, generally designated 410, includes a rotor 412 mounting a plurality of turbine buckets 414. An inner casing 416 is also illustrated mounting a plurality of stator vanes 418. A centrally disposed generally radial steam inlet 420 applies steam to the turbine buckets 414 and stator blades 418 on opposite axial sides of the turbine to drive the rotor 412. The stator vanes blades 418 and the axially adjacent turbine buckets 414 form the various stages of the turbine creating a steam flow path and it will be appreciated that the steam is exhausted from the final stage buckets 419 of the steam turbine for flow into an outlet 426 to a condenser (not shown).

Also illustrated is an outer exhaust hood 430, which surrounds and supports the inner casing 416 of the turbine as well as other parts such as the bearings. The turbine includes outer steam guides 423, 424 for guiding the steam exhausting from the turbine into an outlet 426 for flow to one or more condensers. A plurality of support structures may be provided within the exhaust hood 430 to brace the exhaust hood and to assist in guiding the steam exhaust flow. An exemplary support structure 435 is situated to receive and direct the steam exhaust flow 440 from the steam turbine 410.

The last stage buckets 419 of the steam turbine 410 discharges steam exhaust flow 440 within the exhaust hood 430. The exhaust hood 430 may include an upper hood 431 and a lower hood 432. The exhaust hood 430 discharges downward to an outlet 426 to a condenser below (not shown). The exhaust 430 from the last stage buckets 419 flows between outer steam guides 423, 424 and an inner steam guide 427. A bearing cone 428 or a separate structure may form the inner steam guide 427. The steam guides together 423, 424 may form a concentric ring around the rotor 412. The steam guide 423 in the upper section of the exhaust path may be shaped, oriented and sized differently from the steam guide 424 in the lower half of the exhaust path to efficiently accommodate their respective exhaust paths to the condenser (not shown).

The outer steam guides 423, 424 may include inward radial depressions 425 at a predetermined axial distance 450 along the steam guide wall 480, which may be measured from the centerline 455 of the last stage buckets, as will be described in greater detail. However, other reference points may be used with the measurement adjusted accordingly. The inward radial depressions 425 may form a concentric ring around the rotor 412.

According to the invention, the location for the most inward radial projection of the depression should be at a predetermined axial downstream distance from the last stage buckets. This predetermined downstream distance for the center of the depression may be expressed as a function of the length of the last stage bucket. The minimum axial location from the center of last stage bucket may be about $0.08*L_{lsb}$, where $L_{lsb}$ is the active length of the last stage buckets 419. The maximum axial location from the center of last stage buckets 419 may be about $0.16*L_{lsb}$.

Figure 6:
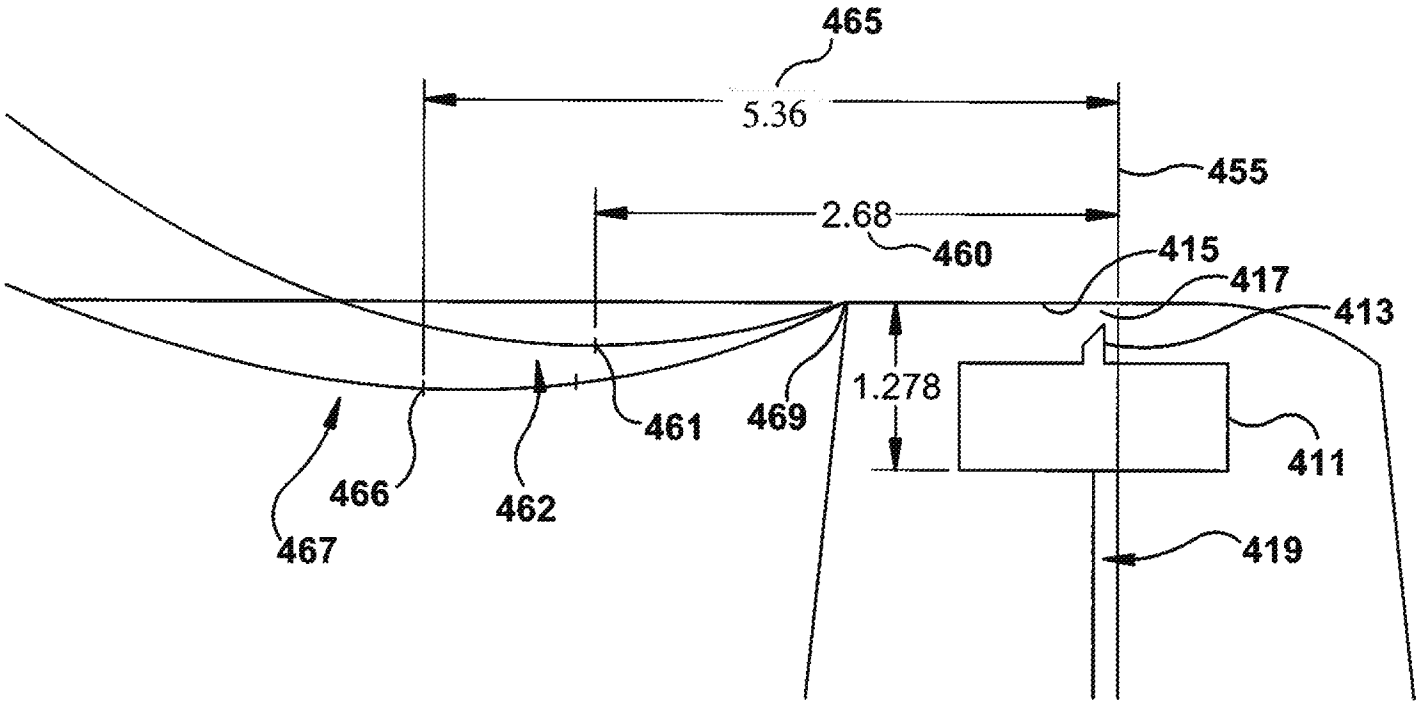
FIG. 6 illustrates a preferred range of locations for the axial center of the depression for a bucket of a specific active length.

FIG. 6 illustrates a range of locations for the axial center of the inward radial depression provided on the inner wall of steam guide downstream from last stage buckets for reducing downstream vortex and improving diffuser performance. For this example, the last stage buckets 419 have a 33.5 inch active length. Steam guide walls 462, 467 begin axially at 469. The last stage buckets 419 may include one or more teeth 413 located on tip shroud 411 forming a leakage clearance 417 with inner wall 415 of the inner casing 416 of the steam turbine (FIG. 5). The minimum axial distance 460 to the inward radial depression 461 on steam guide wall 462 may be determined as approximately 0.08*33.5=2.68 inch. The maximum axial distance 465 to the inward radial depression 466 on steam guide wall 467 may be calculated as approximately 0.16*33.5=5.36 inch.

Further according to the invention, the depth of the inward radial depression relative to the radial height of the top projection of the shroud of the last stage bucket may be set as a predetermined value. The predetermined value for the depression may be expressed as a function of the length of the distance between the underside of the tip shroud and the underside of the inner casing of the turbine. The minimum depth of the depression may be 0.2*H, where H is the distance between the underside of the tip shroud and the underside of the inner casing of the turbine. The maximum depth of the depression may be 0.6*H.

Figure 7:
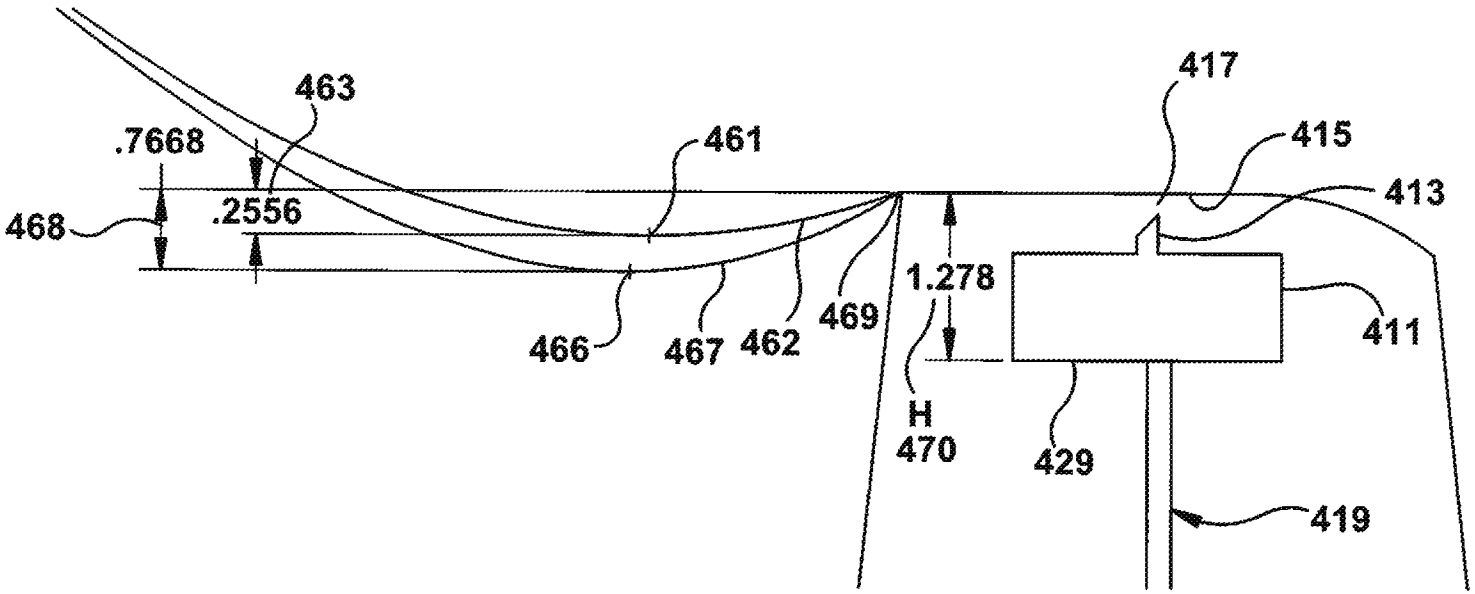
FIG. 7 illustrates a preferred range of depths for the center of the depression of the inner wall of the steam guide for a bucket of a specific height between the underside of the tip shroud and the underside of the inner turbine casing.

FIG. 7 illustrates a preferred range of depths for the inward radial depression of the inner wall of the outer steam guide for reducing downstream vortex and improving diffuser performance. For this example, a last stage bucket includes a distance H of about 1.278 inches between the underside 429 of the tip shroud 411 and the inner wall 415 of inner turbine casing 416. The tip shroud 411 may include one or more teeth 413 establishing a leakage clearance 417 with the inner wall 415 of the inner casing of the steam turbine (FIG. 5). A minimum value for the depth 463 of inward radial depression 461 may be calculated as about 0.2*H or 0.2*1.278 inch=0.2556 inch on steam guide wall 462. The maximum value for the depth 468 of inward radial depression 466 on steam guide wall 467 may be calculated as about 0.6*H or 0.6*1.278 inch=0.7668 inch.

Figure 8:
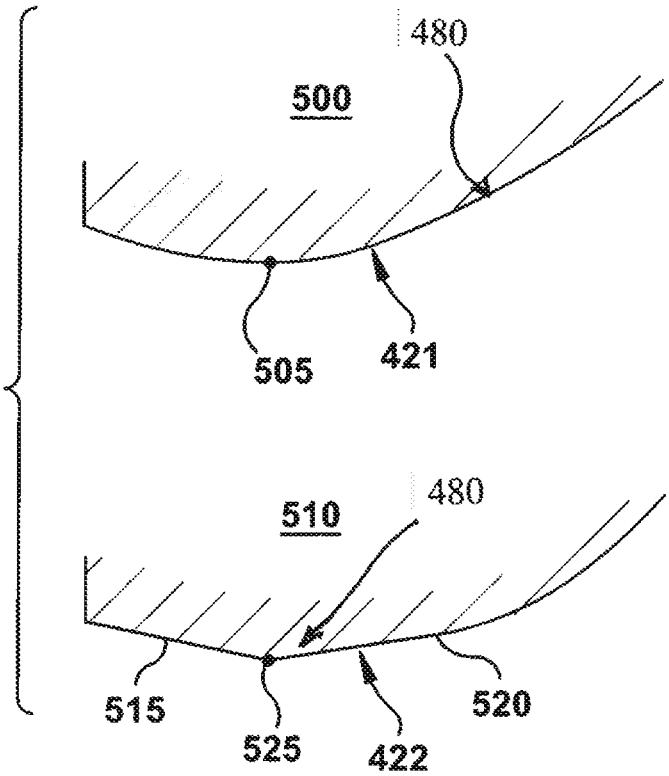
FIG. 8 illustrates various shapes of the inward radial depressions on inner wall of the outer steam guide according to the present invention.

FIG. 8 illustrates various shapes that may be used in forming the inward radial depressions on inner wall of the outer steam guide, downstream from the last stage buckets, according to the present invention. In a first embodiment 500, the underside 421 of the inner wall 415 of inner turbine casing 416 may include a smooth radially-outward concave surface where the inward radial depression 505 forms the radial minimum for the surface. In a further embodiment 510, a straight edge underside 422 of inner wall 415 may be formed as a contracting conical section 515 upstream from the inward radial depression 525 and be formed as an expanding conical section 520 downstream from the inward radial depression 525, such that the two conical sections join at the radial diameter of the inward radial depression 525. The expanding conical section 520 and the contracting conical section 515 may merge with the inner wall at the respective upstream and downstream end. However, it should be understood that the shape of the underside 421, 422 of inner wall 415 may assume a variety of shapes provided the inward radial depression is properly located axially and radially.

Figure 9:
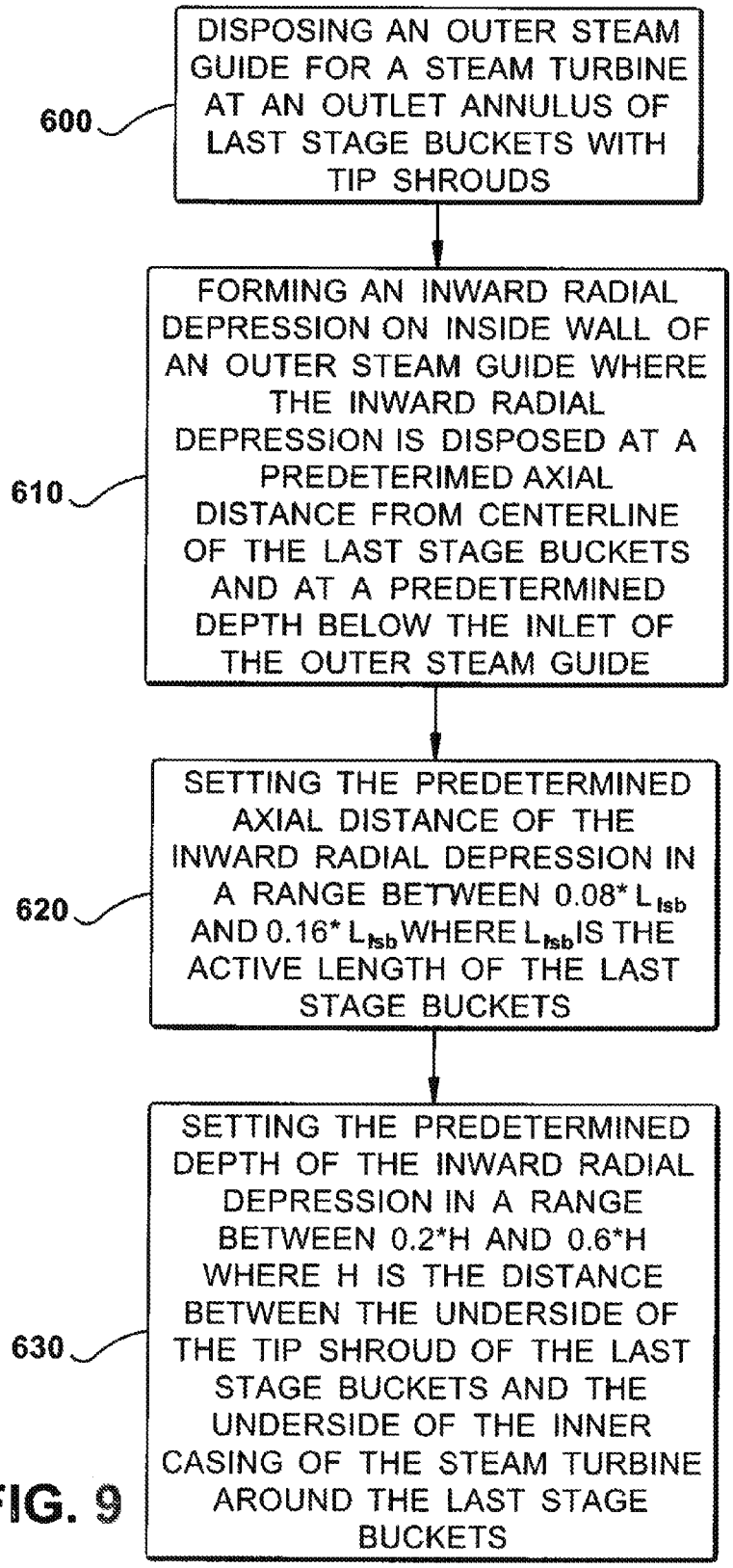
FIG. 9 illustrates a flow chart for the method of reducing the vortex of steam in a diffuser of a condensing steam turbine.

A further aspect of the present invention provides a method for reducing the vortex of steam in a diffuser downstream from the tip shroud of the last stage buckets in a condensing steam turbine. The method includes disposing an outer steam guide at an outlet annulus of last stage buckets with tip shrouds. The method further includes forming a inward radial depression on an inside wall of the outer steam guide wherein the inward radial depression is disposed at a predetermined axial distance downstream from the centerline of the last stage buckets and at a predetermined depth, wherein the axial distance and depth are adapted for reducing the vortex formation along the outer wall of the outer steam guide. The predetermined axial distance of the inward radial depression from the centerline of the last stage buckets comprises a range between $0.08*L_{lsb}$ and $0.16*L_{lsb}$, where $L_{lsb}$ is the active length of the last stage bucket. The predetermined depth of the inward radial depression comprises a range between 0.2*H and 0.6*H where H is the distance between the bottom of a tip shroud of the last stage buckets and the underside of an inner casing of the steam turbine and where the predetermined depth is relative to the radial height of the inner wall at the inlet of the steam guide. FIG. 9 illustrates a flow chart for the method of reducing the vortex of steam in a diffuser of a condensing steam turbine. Step 600 includes disposing an outer steam guide at an outlet annulus of last stage buckets with tip shrouds. Step 610 includes forming a inward radial depression on an inside wall of the outer steam guide wherein the inward radial depression is disposed at a predetermined axial distance downstream from the centerline of the last stage buckets and at a predetermined depth, wherein the axial distance and depth are adapted for reducing the vortex formation along the outer wall of the outer steam guide. Step 620 sets the predetermined axial distance of the inward radial depression from the centerline of the last stage buckets in a range between $0.08*L_{lsb}$ and $0.16*L_{lsb}$, where $L_{lsb}$ is the active length of the last stage bucket. Step 630 sets predetermined depth of the inward radial depression comprises a range between 0.2*H and 0.6*H where H is the distance between the bottom of a tip shroud of the last stage buckets and the underside of an inner casing of the steam turbine and where the predetermined depth is relative to the radial height of the inner wall at the inlet of the steam guide.

While the foregoing has described several embodiments of shapes of the wall surrounding the depression, it should be understood that other shapes may be included within the scope of the present invention. Further, while various embodiments are described herein, it will be appreciated from the specification that various combinations of elements, variations or improvements therein may be made, and are within the scope of the invention.

The invention claimed is:

1. A low-pressure steam turbine comprising:

an inner casing including a last stage bucket annulus;

tip shrouds on a plurality of buckets of the last stage bucket annulus;

an exhaust hood surrounding the inner casing; and an axial radial diffuser comprising an inner steam guide and an outer steam guide within the exhaust hood at the outlet of the last stage bucket annulus wherein an inner wall of the outer steam guide includes an inward radial depression adapted to reducing a vortex of steam on the inside wall of the outer steam guide downstream from the outlet of the last stage bucket.

2. The low-pressure steam turbine according to claim 1, wherein the inward radial depression on the outer steam guide includes a predetermined depth of depression at an axial orientation relative to the last stage buckets.

3. The low-pressure steam turbine according to claim 2, wherein the inward radial depression on the outer steam guide is disposed a minimum distance axially downstream from the center of the last stage bucket of $0.08*L_{lsb}$, where $L_{lsb}$ represents the active length of the last stage buckets.

4. The low-pressure steam turbine according to claim 2, wherein the inward radial depression on the outer steam guide is disposed a maximum distance axially downstream from the center of the last stage bucket of $0.16*L_{lsb}$, where $L_{lsb}$ represents the active length of the last stage bucket.

5. The low-pressure steam turbine according to claim 4, wherein the inward radial depression on the outer steam guide includes a minimum depth of 0.2*H, where H represents a distance from an underside of the tip shroud to an underside of the inner casing.

6. The low-pressure steam turbine according to claim 1, wherein the radial depression on the outer steam guide includes a maximum depth of 0.2*H, where H represents a distance from an underside of the tip shroud to an underside of the inner casing.

7. The low-pressure steam turbine according to claim 1, wherein a diffuser ratio lies in a range of 1.2 to 2.0.

8. The low-pressure steam turbine according to claim 1, wherein the steam turbine comprises a double-axial flow steam turbine.

9. An axial radial diffuser disposed downstream from a last stage annulus of buckets for a condensing steam turbine within an exhaust hood, the diffuser comprising:

an inner steam guide including an inner wall;

an outer steam guide including an outer wall;

an inward radial depression disposed downstream from the outlet of the last stage bucket on an inside wall of the outer steam guide wherein the axial positioning and a depth of the depression are selected to reducing a steam vortex on the outer radial wall downstream from the outlet of the last stage bucket.

10. The axial radial diffuser according to claim 9, wherein the inward radial depression is disposed a minimum distance axially downstream from an outlet of the last stage bucket of $0.08*L_{lsb}$, where $L_{lsb}$ represents the active length of the last stage buckets.

11. The axial radial diffuser according to claim 10, wherein the inward radial depression is disposed a maximum distance axially downstream from the outlet of the last stage bucket of $0.08*L_{lsb}$, where $L_{lsb}$ represents the active length of the last stage buckets.

12. The axial radial diffuser according to claim 9, wherein the radial depression includes a minimum depth of 0.2*H, where H represents a distance from an underside of the tip shroud to an underside of the inner casing.

13. The axial radial diffuser according to claim 12, wherein the radial depression includes a maximum depth of 0.6*H, where H represents a distance from an underside of the tip shroud to an underside of the inner casing.

14. The axial radial diffuser according to claim 9, wherein a diffuser ratio lies in a range of 1.2 to 2.0.

15. The axial radial diffuser according to claim 9, wherein the inward radial depression is disposed between a minimum distance axially downstream from an outlet of the last stage bucket of $0.08*L_{lsb}$, and a maximum distance axially downstream from the outlet of the last stage bucket of $0.08*L_{lsb}$, where $L_{lsb}$ represents the active length of the last stage buckets; and wherein the radial depression includes a minimum depth of 0.2*H, and a maximum depth of 0.6*H, where H represents a distance from an underside of the tip shroud to an underside of the inner casing.

16. The axial radial diffuser according to claim 9, wherein the outer wall of the outer steam guide forms a radially outward concave smooth surface.

17. The axial radial diffuser according to claim 9, wherein the outer wall of the outer steam guide forms a radially outward piecewise linear outward concave surface.

18. A method for reducing vortex formation on an outer steam guide of a diffuser for a steam turbine downstream of last stage buckets with tip shrouds, the method comprising:

disposing an outer steam guide and an inner steam guide at an outlet annulus of last stage buckets;

providing a inward radial depression on an inside wall of the outer steam guide wherein the inward radial depression is disposed at a predetermined axial distance downstream from the centerline of the last stage buckets and at a predetermined depth, wherein the axial distance and depth are adapted for reducing the vortex formation along the outer wall of the outer steam guide.

19. The method according to claim 18, wherein the predetermined distance of the inward radial depression from the centerline of the last stage buckets is between $0.08*L_{lsb}$ and $0.16*L_{lsb}$, where $L_{lsb}$ is the active length of the last stage bucket.

20. The method according to claim 18, wherein the predetermined depth of the inward radial depression comprises a range between 0.2*H and 0.6*H where H is the distance between the bottom of a tip shroud of the last stage buckets and the underside of an inner casing of the steam turbine.

* * * * *